United States Patent [19]

Loman

[11] 4,164,132

[45] Aug. 14, 1979

[54] KEY RETAINER

[75] Inventor: George Loman, Orange, Conn.

[73] Assignee: The W. E. Bassett Company, Derby, Conn.

[21] Appl. No.: 913,388

[22] Filed: Jun. 7, 1978

[51] Int. Cl.[2] ..... A47G 29/10

[52] U.S. Cl. ..... 70/456 R; 70/459

[58] Field of Search ..... 70/456 R, 459, 456 B, 70/457, 458; 24/3 R

[56] References Cited

U.S. PATENT DOCUMENTS

| | | | |
|---|---|---|---|
| 3,621,691 | 11/1971 | Leopoldi | 70/459 |
| 4,037,443 | 7/1977 | Motzer | 70/459 |

FOREIGN PATENT DOCUMENTS

| | | | |
|---|---|---|---|
| 1505852 | 11/1967 | France | 70/459 |

*Primary Examiner*—Robert L. Wolfe

*Attorney, Agent, or Firm*—Hopgood, Calimafde, Kalil, Blaustein & Lieberman

[57] ABSTRACT

The invention contemplates a key retainer with a key-retaining bail extending beyond one end of a case, for selective retention of one or more keys. The combination involves the bail formed as an integral hook-like part of pivoted body structure within the case. Pivotal action is limited, and deliberate manual actuation of the body structure against a preloading spring is necessary to displace the free end of the hook from (a) a first normally retained position in which the hook is effectively closed by its relation to the case, to (b) a second and temporary position in which the free end of the hook is sufficiently upwardly offset from the case to permit selective key insertion in and/or removal from the bail.

9 Claims, 6 Drawing Figures

KEY RETAINER

The invention relates to a key-retaining device of the variety in which a key-holding bail is assembled to a case.

In prior devices of the character indicated, exemplified by U.S. Pat. No. 4,037,443, a bail forms part of a slide contained within case structure by means of which slide action is confined to the direction transverse to the direction in which the bail extends outwardly of the case. The slide is resiliently urged in the direction to effectively close the loop of the bail, and while these forces are transverse to the direction in which a key may be pulled from its lock, the slide action encounters frictional resistance of varying magnitude, depending upon the care with which and the direction in which bail-displacement force is applied in order to open the retainer for reception or removal of a key. Furthermore, assembled retention of the case parts presents problems of assuring proper guidance of the slide, without entailing undue structural complexity, with attendant relatively high manufacturing cost.

It is an object of the invention to provide an improved movable-bail key-retaining device avoiding the above-noted limitation of past structures.

A specific object is to meet the above object with structure wherein, short of destroying the parts, it is extremely difficult if not inherently impossible to dislodge a given bail connection to a key, whatever the pulling force, when the case, the bail and the key are pulled substantially on the axis of key-insertion in the lock.

A general object is to achieve the above objects with structure of elemental simplicity, low cost and ease of operation and manufacture.

Other objects and various further features of novelty and invention will be pointed out or will occur to those skilled in the art from a reading of the following specification in conjunction with the accompanying drawings.

Figure 1:
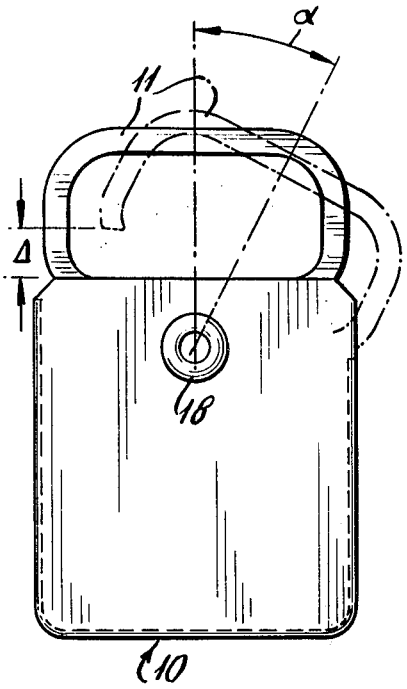
FIG. 1 is a view in elevation of a movable-bail key retainer of the invention.
Figure 2:
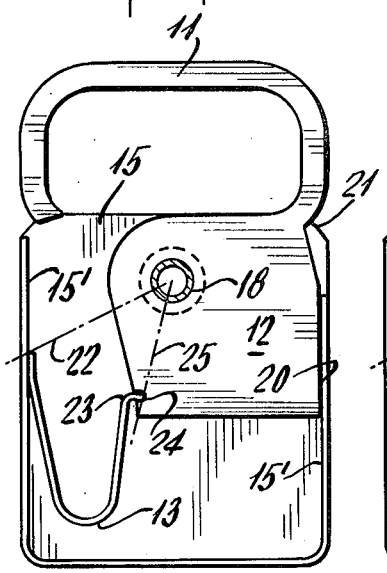
FIG. 2 is a view similar to FIG. 1 with the front-panel of the case removed, to show the relation of parts for the bail-closed position.

The illustrative retainer shown in the drawings comprises case structure 10, a generally C-shaped or hooked bail 11 formed integrally with a pivotally suspended body 12, and a spring element 13 normally urging the bail member (i.e., bail 11 and its body 12) to the "closed" position shown in full lines in FIGS. 1 and 2, the open position being shown in phantom outline at 11' in FIG. 1.

Figure 4:
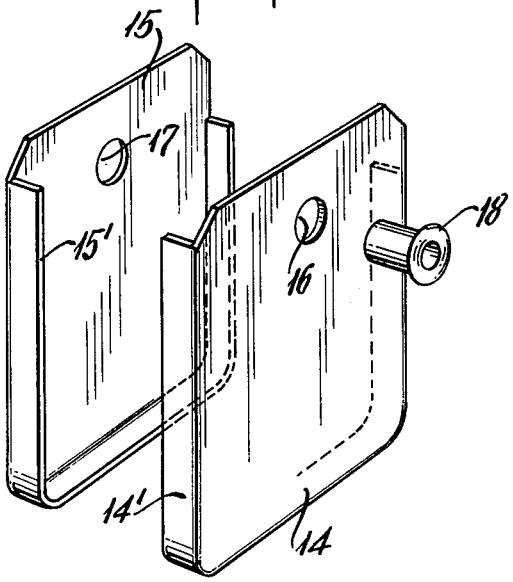
FIG. 4 is an exploded view in perspective to show case parts.

The case 10 happens to be shown as relatively thin and generally rectangularly prismatic, but its shape is not of critical importance. As shown, case 10 comprises front and back panel halves 14 and 15 (FIG. 4), with peripheral flanges or edge walls 14'–15' which nest or telescope upon fitted assembly, the front-panel flanges 14' being shown lapped over the rear-panel flanges 15'. The peripheral extent of flanges 14'–15' is effectively along three of the four edges of the case, leaving an opening along the remaining edge of the case. The panel members 14–15 have registering openings 16–17 for reception of rivet means such as an eyelet 18, which serves not only to retain the panel members in assembled relation but also to retain and provide pivotal suspension for the body 12 of the bail member, via a pivot aperture 19 in body 12.

It is preferred that the alignment of rivet openings 16–17 shall be near the elevation of the open edge of the case and substantially midway between adjacent closed side edges of the case, as shown. This relationship enables a reasonable bail-opening displacement $\alpha$ for a rotational displacement $\Delta$, while assuring retention of the parts near the open edge of the case, where any attempt to twist the bail with respect to the case is best and most effectively resisted.

Figure 5:
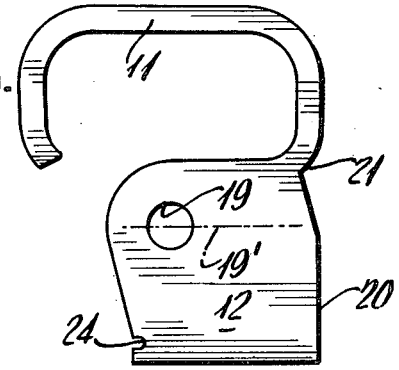
FIG. 5 is a view in elevation of the movable-bail member of FIG. 1.
Figure 6:
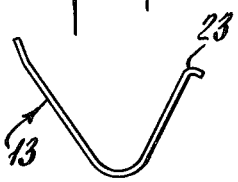
FIG. 6 is a view of a spring element, in unstressed condition.

The bail member is shown in FIG. 5 to comprise an extensive body 12 which extends primarily below and to one side of the pivot opening 19, thus providing an elongate abutment edge 20 which coacts with the adjacent inner contour of panel flange 15' to determine the bail-closed limit of pivotable displacement; in the form shown, edge 20 and the flange it abuts are both straight. Above the elevation 19' of the pivot axis, the edge 20 is arcuate about the opening 19, to the point of juncture with the integrally connected end of bail 11, thus establishing effective notch or stop 21 which abuts the upper end of the adjacent flange 15' (see FIG. 3) to determine the bail-open limit of pivotal displacement. It will be noted that for the preferred form shown, both such limiting abutments occur at radial-offset distances from the pivot axis which are substantial, namely, about one half of the effective span of the bail and of the bail-receiving end of the case.

Figure 3:
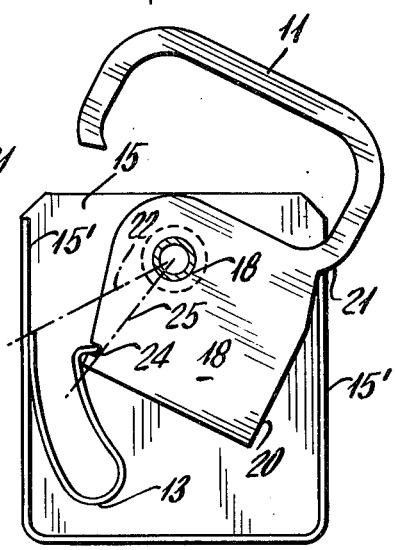
FIG. 3 is a view similar to FIG. 2, for the bail-open position.

Spring 13 is shown simply as a V-shaped ribbon stressed to rotationally preload the bail-body 12 at all times in the direction of the "closed" position. Preferably, spring 13 is so constructed and located as to assure a resultant spring force vector which is at all times below a limiting alignment 22 (FIG. 2), being the geometrical line between the pivot axis and the uppermost point of contact between spring 13 and the adjacent portion of the edge flange 15' against which spring 13 is preloaded. At its other end 23, spring 13 is shown to be outwardly bent, for locating engagement in a notch 24 of body 12. And notch 24 is preferably at substantial radial offset beneath the pivot axis, assuring preloaded spring-force application to body 12 with maximum bail-closing moment and in the direction substantially normal to the bail-closed abutment edge 20. FIGS. 2 and 3 show that for all pivotable positions of body 12 the geometric radius line 25 from the pivot axis to notch 24 remains below the geometrical line 22.

It will be seen that the described key retainer meets all stated objects. Either or both of the case and bail-member parts may be of plastic or metal, but metal is preferred. In metal, the device is accurately and ruggedly manufactured using well-known techniques. The bail 11 and its body 12 may be of extremely rugged and hardened nature, and the rivet 18 performs its dual functions at the upper region where positive and effective assembly retention is most needed. Finally, the described geometrical porportions are found to provide utmost resistance to loss of the "closed" condition of the retainer, in that virtually no amount of pull (when the case 10 and bail 11 are substantially aligned with a key-insertion axis) can jeopardize the "closed" condition.

While the invention has been described in detail for the form shown, it will be understood that modifications may be made without departure from the scope of the invention.

What is claimed is:

1. In a key retainer or the like, a case defined by and between spaced edge-fitted front and back panel members, with an opening at one end, a bail member including a body portion essentially contained within the space between and pivotally connected to said panel members, said bail member also including a C-shaped bail portion integrally connected at one end to said body portion and extending essentially outside said panel members via the end opening, said panel members and said body portion having aligned pivot apertures, rivet means through the aligned apertures and serving to retain said panel members in assembled relation to each other and to said body portion while also supporting said bail member for a limited angular range of pivoted bail-portion movement external to and with respect to said case, the other end of said bail portion being spaced from said body portion such that (a) in one limiting pivoted position the said other end of said bail portion coacts with the adjacent region of said case to define an effectively closed key-retaining bail loop and (b) in a second limiting pivoted position said other end of said bail portion is spaced from said case to an extent permitting selective key application to or removal from said bail, and spring means coacting between said bail-member body portion and said case and resiliently urging said bail member in the direction of said one position.

2. The key retainer of claim 1, in which the pivot apertures of said panel members are located generally centrally of and near said one end of said case.

3. The key retainer of claim 1, in which the fitted edges of said panel members include at least one edge wall along the edge near said one end of said bail portion, said first limiting position being determined by interfering abutment of said body portion with said one edge wall, and said second limiting position being determined by interfering abutment of said bail portion with said one edge wall.

4. The key retainer of claim 3, in which each of said abutments occurs at a radial offset from the pivot axis, which offset is at least substantially one half the effective span of the case opening.

5. The key retainer of claim 1, in which the fitted edges of said panel members include at least one edge wall along the edge near said other end of said bail portion, and in which said spring means comprises a stiffly compliant generally V-shaped member with one free end in compressionally preloaded abutment with said one edge wall and with its other free end in compressionally preloaded abutment with said body portion at a location below the pivot axis.

6. The key retainer of claim 5, in which said other free end is characterized by a laterally outward projection, and in which said body portion has a locating notch engaging said projection.

7. The key retainer of claim 5, in which for both said limited positions the location of spring engagement with said body portion is beneath the geometrical line between the pivot axis and the uppermost point of contact of said spring means with said one edge wall.

8. The key retainer of claim 6, in which said notch is radially offset beneath the pivot axis, to the extent of at least substantially one half the effective span of the case opening.

9. The key retainer of claim 1, in which said panel members are characterized by continuous edge walls in telescoped interfit, from one to the other end of the lateral extent of the end opening of said case.

* * * * *